US010766669B2

(12) United States Patent
Septien Rojas et al.

(10) Patent No.: US 10,766,669 B2
(45) Date of Patent: Sep. 8, 2020

(54) FOUR-FLANGE CHILD-RESISTANT ZIPPER AND BAG

(71) Applicant: ILLINOIS TOOL WORKS INC., Glenview, IL (US)

(72) Inventors: Jose Manuel Septien Rojas, Scarborough (GB); Nigel Dean Knight, Kankakee, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 16/594,327

(22) Filed: Oct. 7, 2019

(65) Prior Publication Data

US 2020/0108979 A1 Apr. 9, 2020

Related U.S. Application Data

(60) Provisional application No. 62/741,721, filed on Oct. 5, 2018.

(51) Int. Cl.
*B65D 33/25* (2006.01)

(52) U.S. Cl.
CPC ..... *B65D 33/2541* (2013.01); *B65D 2215/04* (2013.01)

(58) Field of Classification Search
CPC ..... B65D 33/2508; B65D 33/2541; B65D 2215/04; B65D 2215/08; Y10T 24/45168
See application file for complete search history.

(56) References Cited

U.S. PATENT DOCUMENTS 2,789,609 A 4/1957 Post
5,774,954 A * 7/1998 Ramsey ..... B65D 33/2533 24/304
5,832,570 A * 11/1998 Thorpe ..... B65D 33/2533 24/585.12

(Continued)

FOREIGN PATENT DOCUMENTS

CN 108577109 9/2018
WO PCT/US2018/044941 8/2018
WO 2019/028216 2/2019

OTHER PUBLICATIONS

International Search Report issued in PCT/US2019/054942 dated Jan. 14, 2020.

*Primary Examiner* — Robert Sandy
*Assistant Examiner* — Louis A Mercado
(74) *Attorney, Agent, or Firm* — McCarter & English, LLP

(57) ABSTRACT

The present disclosure relates to a plastic or polymeric container (100) with reclosable zippers or reclosures (10) which make the package child-resistant. In one typical embodiment, this is achieved by a zipper or reclosure (10) including a first profile (12) with a first lower interlocking element (28) and a first upper interlocking element (29), wherein the first profile (12) is severed through the first upper interlocking element (29) to form a lower first profile (12') and an upper first profile (12"). This severing forms at least one tab (18) extending from an upper edge of the lower first profile (12') and including a portion of the first upper interlocking element (29'). The second profile (14) includes a second web portion (30) with a second lower interlocking element (44) and a second upper interlocking element (46).

15 Claims, 9 Drawing Sheets

(56) References Cited

U.S. PATENT DOCUMENTS 5,908,245 A * 6/1999 Bost ..... B65D 33/007 206/554
6,004,032 A 12/1999 Kapperman et al.
6,360,513 B1 * 3/2002 Strand ..... B65D 33/2591 493/213
6,767,423 B1 * 7/2004 Johnson ..... B29D 5/10 156/226
7,254,873 B2 * 8/2007 Stolmeier ..... B65D 33/2591 24/400
7,553,083 B2 * 6/2009 Plourde ..... B65B 9/20 383/203
8,727,620 B2 * 5/2014 Dais ..... B65D 33/2508 24/399
9,015,910 B2 * 4/2015 Septien Rojas ..... A44B 19/16 24/399
9,114,914 B2 * 8/2015 Dais ..... B65D 33/28
9,284,097 B2 * 3/2016 Heckman ..... B65D 33/2508
9,896,241 B2 * 2/2018 Anzini ..... B65D 33/2508
10,093,457 B2 * 10/2018 Steele ..... B65D 33/2508
2009/0129707 A1 * 5/2009 Howell ..... B65D 33/2508 383/64
2009/0257685 A1 * 10/2009 Matias ..... B65D 33/2566 383/38
2011/0311167 A1 * 12/2011 Hall ..... B65D 33/2541 383/61.2
2014/0093193 A1 * 4/2014 Dais ..... B65D 33/004 383/65
2014/0143988 A1 * 5/2014 Septien Rojas .... B65D 33/2558 24/402
2016/0031608 A1 * 2/2016 Olechowski ..... B65D 33/007 383/210.1
2016/0101904 A1 * 4/2016 Takigawa ..... B65D 33/2566 24/30.5 R
2016/0122087 A1 5/2016 Takigawa
2017/0152085 A1 6/2017 Septien Rojas
2018/0148225 A1 * 5/2018 Vandamme ..... B65D 75/008

* cited by examiner

FOUR-FLANGE CHILD-RESISTANT ZIPPER AND BAG

This application claims priority under 35 U.S.C. § 119(e) of U.S. provisional application Ser. No. 62/741,721, filed on Oct. 5, 2018, the contents of all of which is hereby incorporated by reference in its entirety and for all purposes.

BACKGROUND OF THE DISCLOSURE

Field of the Disclosure

The present disclosure relates to a child-resistant reclosable zipper with four flanges, along with packages or bags incorporating the zipper, particularly wherein a profile of the reclosure includes tabs which have locking elements for engagement with the opposing profile and which must be separated by peeling the tabs away from the opposing profile.

Description of the Prior Art

The prior art includes various child-resistant packages. Typically, these packages are designed to hold medicinal capsules, detergent capsules, or similar items which might be attractive, but harmful, to a child. The prior art has many examples of plastic lids, which, in order to be removed from the glass or plastic container, must be squeezed or pushed in various ways which would not be apparent to a child or would be beyond the strength capabilities of the child. However, such containers are complicated to manufacture and add considerable expense to the consumer product. Additionally, such containers may be heavy and bulky which adds to the costs of transportation. Furthermore, this weight and bulk adds to the recycling burden of these products.

The prior art includes U.S. Published Application No. 2017/0152085, published Jun. 1, 2017, to Rojas, entitled "Child-Resistant Reclosable Packages," and PCT application PCT/US2018/044941 filed on Aug. 2, 2018, entitled "Child-Resistant Reclosable Bags."

OBJECTS AND SUMMARY OF THE DISCLOSURE

It is therefore an object of the present disclosure to provide child-resistant containers which maintain a high level of child resistance, while achieving reduced weight and costs with respect to manufacture, transportation and recycling.

These and other objects are achieved by a plastic or polymeric container with reclosable zippers which make the package child-resistant. In one typical embodiment, this is achieved by a zipper with four flanges, including a tab with a tab track that engages with an opposite track on an opposite flange. One of the profiles is severed longitudinally into two pieces along one of the sets of interlocking elements, thereby forming the tabs with the tab track formed by a portion of the severed set of interlocking elements. A user disengages the tab track from the opposite track in order to expose the tab, which is subsequently used to open the remainder of the zipper. An additional embodiment includes a hinged engagement immediately below the level of the tabs.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
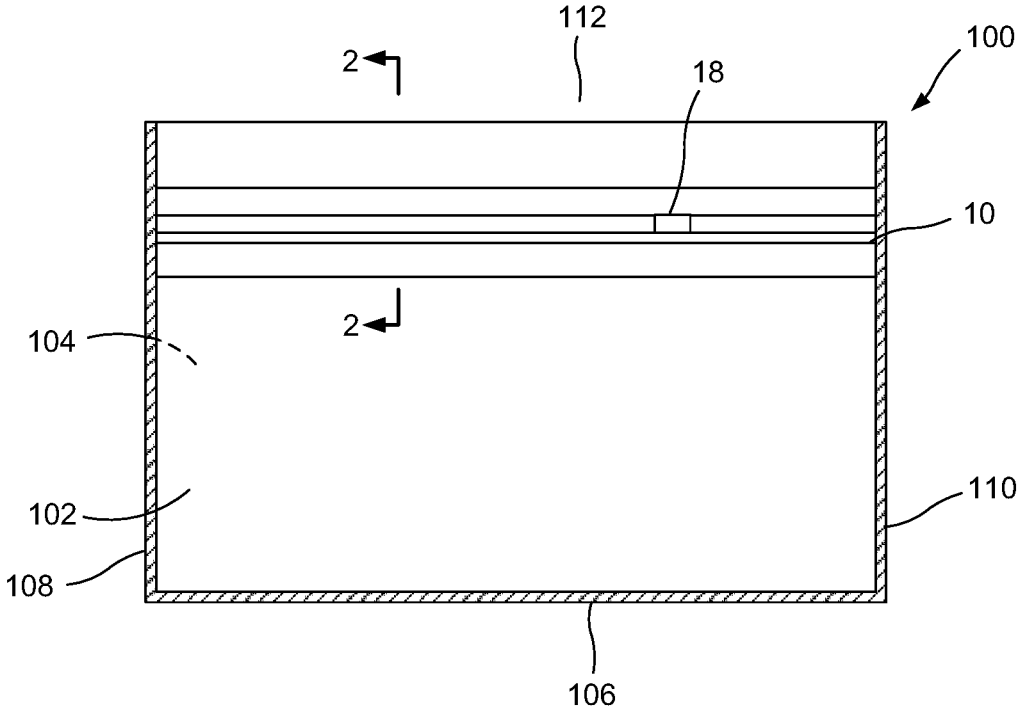
FIG. 1 is a plan view of a typical reclosable package with a reclosure which is an embodiment of the present disclosure.

Referring now to the drawings in detail wherein like numerals refer to like elements throughout the several views, one sees that FIG. 1 discloses a typical reclosable package 100 with an embodiment of the closure, reclosure or zipper 10 of the present disclosure.

While reclosure 10 can be utilized with a wide range of packages, one sees that the typical package 100 of FIG. 1 is made from first and second co-extensive polymeric sheets of material 102, 104, which are sealed to each other at bottom seal 106 and first and second side seals 108, 110, thereby forming mouth 112 which is made reclosable by reclosure 10 which extends transversely across the top of the package 100, downwardly adjacent from the upper edge of first and second sheets of material 102, 104. In some embodiments, first and second sheets of material 102, 104 can be replaced with a single sheet of material with a fold in place of bottom seal 106 or side seals 102, 104.

Figure 2:
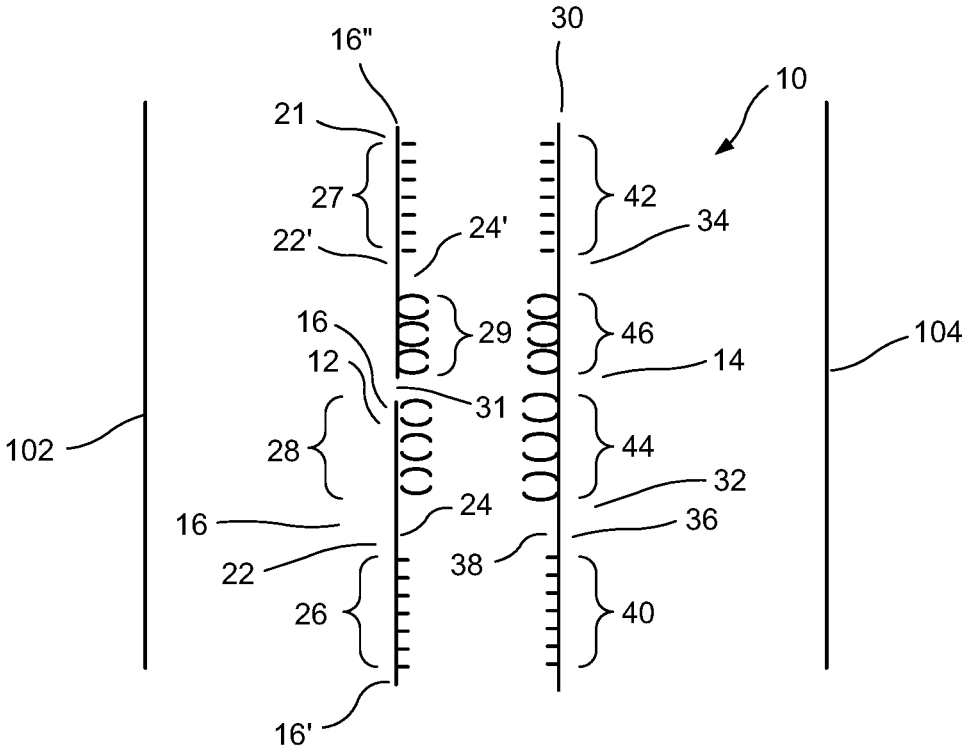
FIG. 2 is an exploded cross-sectional view along plane 2-2 of FIG. 1.
Figure 3:
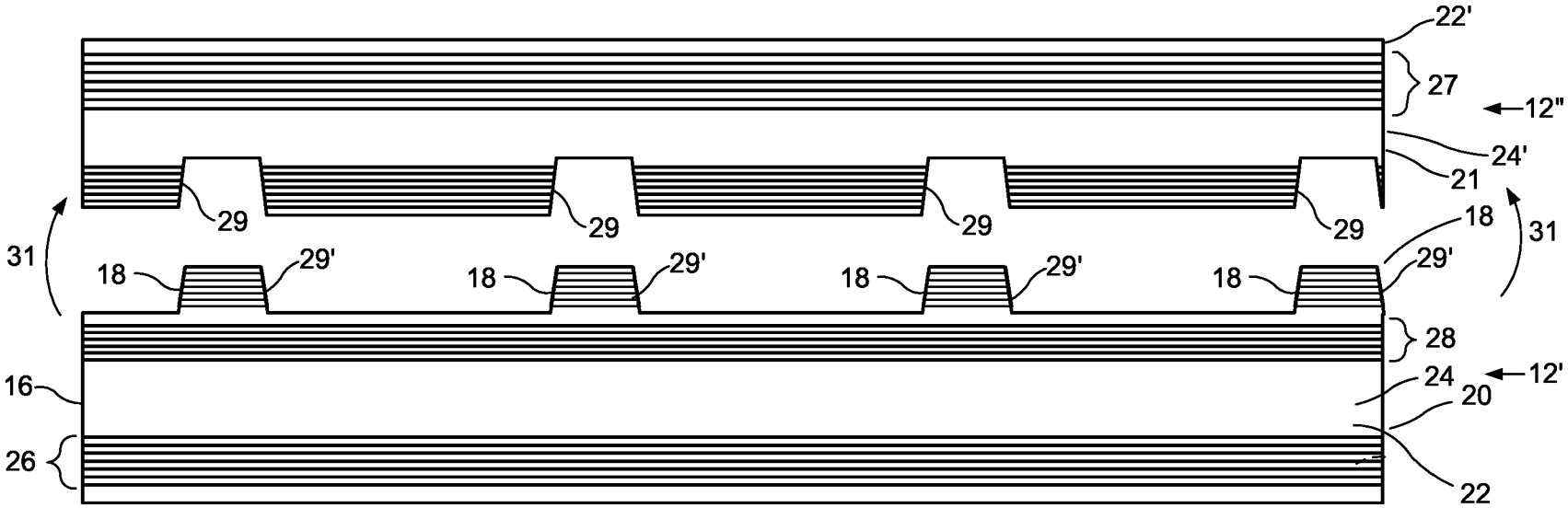
FIG. 3 is a partially exploded plan view of a first profile of an embodiment of the reclosure of the present disclosure.
Figure 4:
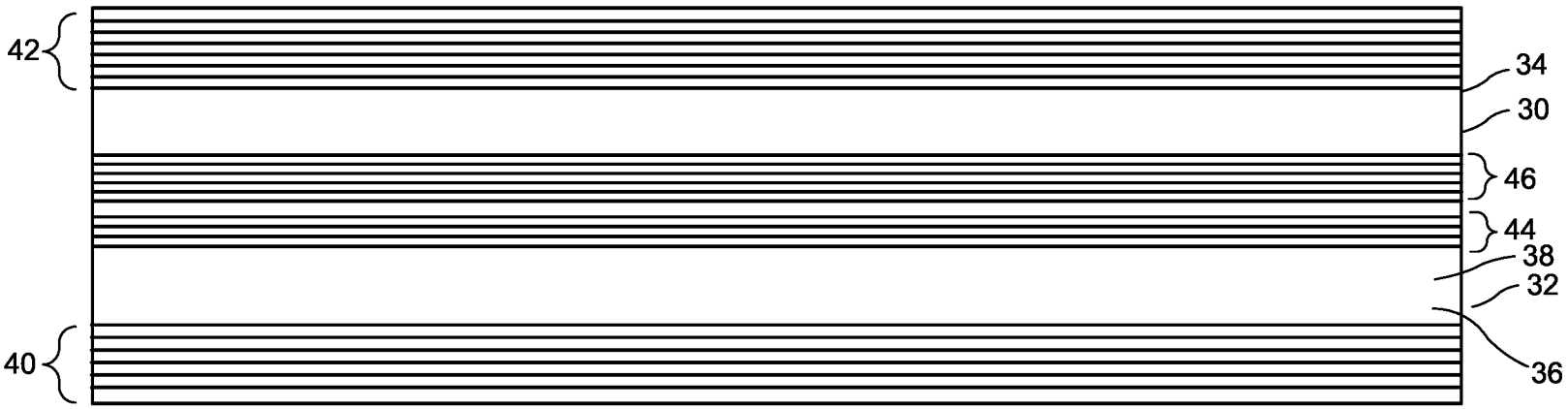
FIG. 4 is a plan view of a second profile of an embodiment of the reclosure of the present disclosure.
Figure 5A:
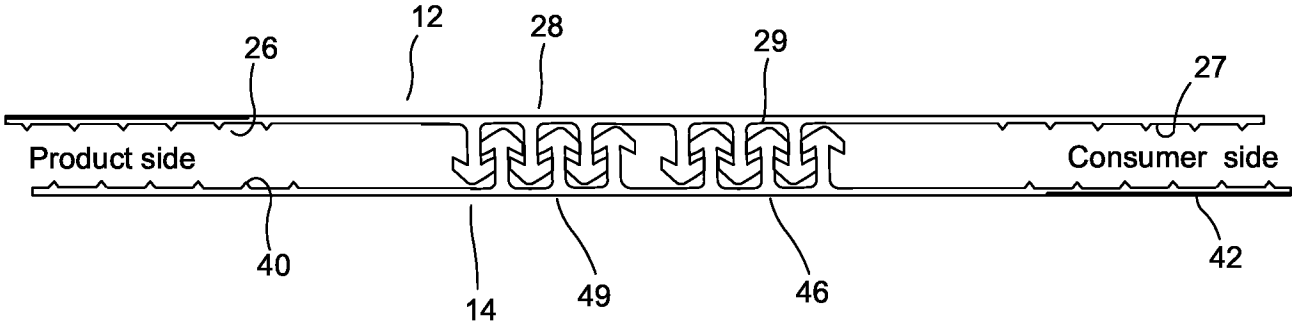
FIG. 5A and FIG. 5B illustrate further aspects of the reclosure of the present disclosure.

FIG. 2 (also see FIG. 5A) is an exploded cross-sectional view along plane 2-2 of FIG. 1, showing the cross-sectional view of first and second profiles 12, 14, along with the first and second sheets of material 102, 104. The reclosure 10 includes first profile 12, which is sealed or otherwise attached to the interior wall of first sheet 102, and second profile 14, which is sealed or otherwise attached to the interior wall of second sheet 104. As will be described in detail, first profile 12 includes upwardly extending tab 18. FIGS. 3 and 4 illustrate the interior surfaces (i.e., the surfaces which face the opposing profile) of a length of the material for the first and second profiles 12, 14, respectively.

Figure 5B:
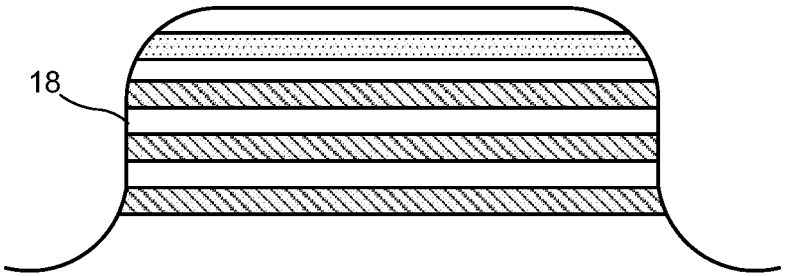

As shown in FIG. 3, a length of the material for the first profile 12 includes a generally rectangular strip-like portion of web 16, divided by severed line 31 into lower first profile 12' and upper first profile 12" with at least one tab 18 (also see FIG. 5B) extending upwardly from an upper surface of lower first profile 12' as defined by severed line 31 (shown in an exploded configuration between lower first profile 12' and upper first profile 12"). Tabs 18 may be spaced apart such that a single tab 18 is included within the width of a package 100. The plurality of tabs 18 illustrated in FIG. 3 may indicate either that multiple tabs 18 may occur spaced apart periodically within a package 100, or that the length of material is cut so that a single tab 18 is placed within a single package 100, as illustrated in FIG. 1. The lower portion of lower first profile 12' is a first lower sealing flange 20 that includes an outwardly facing smooth side 22 for sealing to the first sheet of material 102 and further includes an inwardly facing side 24 with several longitudinally extending anti-sealing protrusions 26. Likewise, the upper portion of upper first profile 12" is a first upper sealing flange 21 that includes an outwardly facing smooth side 22' for sealing to the first sheet of material 102 and further includes an inwardly facing side 24' with several longitudinally extending anti-sealing protrusions 27. These anti-sealing protrusions 26, 27 extend toward the second profile 14 and are intended to prevent or reduce any sealing between the first and second profiles 12, 14 during the sealing process between the first profile 12 and the first sheet of material 102 and between the second profile 14 and the second sheet of material 104.

In one embodiment, a single tab 18 is 5 mm tall and 10 mm wide. In another embodiment, two tabs 18 are present on the same side of the reclosable package 100 with similar dimensions. In yet another embodiment, a single tab is present that is taller and wider than 5×10 mm. The tabs 18 are formed by the severing of first profile 12 along first upper interlocking tracks 29, thereby forming the tab tracks 29' on tabs 18 from first upper interlocking tracks 29.

The first and second profiles 12, 14, including the zipper closure (interlocking tracks 28, 29, tabs 18 with tab tracks 29', and opposite interlocking tracks 44, 46), are manufactured from plastics or polymers known in the art. For example, the first and second profiles 12, 14 may be manufactured from, but not limited to, polyethylene or polypropylene. The reclosable bag is made from, for example, but not limited to, PolyEthylene Terephthalate (PET) laminate film. PET laminate film offers high seal integrity and good moisture barrier characteristics. The first and second profiles may be applied to the reclosable package 100 during, for example, but not limited to, a vertical form fill and seal (VFFS) packing line.

First lower interlocking tracks 28 are parallel to each other and positioned at an upper longitudinal area of strip-like portion of rectangular web 16, below tabs 18. First lower interlocking tracks 28 are arranged and configured to be releasably interlockable with complementary second lower interlocking tracks 44 (see FIG. 4) of second profile 14. Additionally, tabs 18 include first upper interlocking tab tracks 29' which are parallel to each other and arranged and configured to be releasably interlockable with complementary second upper interlocking tracks 46 (see FIG. 4).

As shown in FIG. 4, a length of material for the second profile 14 includes a generally rectangular strip-like portion of web 30, of an illustrated width (i.e., the vertical dimension in FIG. 4) equal to that of first profile 12. However, this width may vary within reason without affecting functionality. The lower portion of second profile 14 is a second lower sealing flange 32 while the upper portion of second profile 14 is a second upper sealing flange 34. Lower and upper second sealing flanges 32, 34 includes an outwardly facing smooth side 36 for sealing to the second sheet of material 104 and further includes an inwardly facing side 38 with several longitudinally extending anti-sealing protrusions 40, 42 positioned on the interior of second lower sealing flange 32 and second upper sealing flange 34, respectively. These anti-sealing protrusions 40, 42 extend toward the first profile 12 and are intended to prevent or reduce any sealing between the first and second profiles 12, 14, or between the second profile 14 and the first sheet of material 102 during the sealing process between the first profile 12 and the first sheet of material 102 and between the second profile 14 and the second sheet of material 104.

The length of material for the second profile 14 includes second lower interlocking tracks 44 which are parallel to each other and arranged and configured to be releasably interlockable with complementary first lower interlocking tracks 28 of first profile 12 (i.e., lower first profile 12'). The length of material for the second profile 14 further includes second upper interlocking tracks 46 which are parallel to each other and arranged and configured to be releasably interlockable with complementary first upper interlocking tab tracks 29 of upper first profile 12" and tab tracks 29' on tabs 18 of lower first profile 12'). Second lower and upper interlocking tracks 44, 46 are formed parallel and adjacent to each other, between second lower and upper sealing flanges 32, 34.

In the interlocked configuration, first and second upper interlocking tracks 29, 46 are interlocked with each other and first and second lower interlocking tracks 28, 44 are interlocked with each other.

Figure 6A:
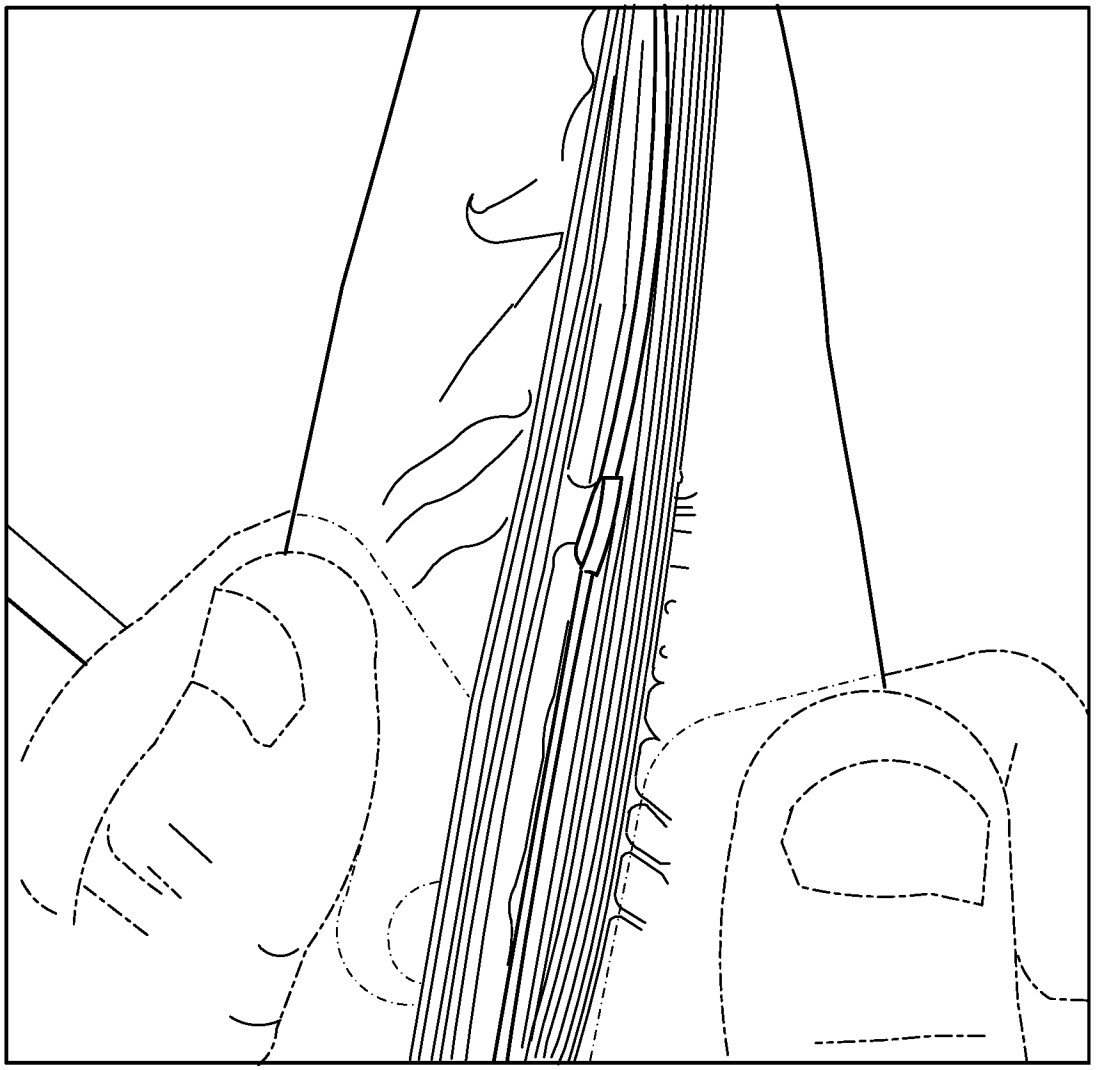
FIG. 6A-6F illustrate the steps for opening an embodiment of the reclosure of the present disclosure.
Figure 6B:
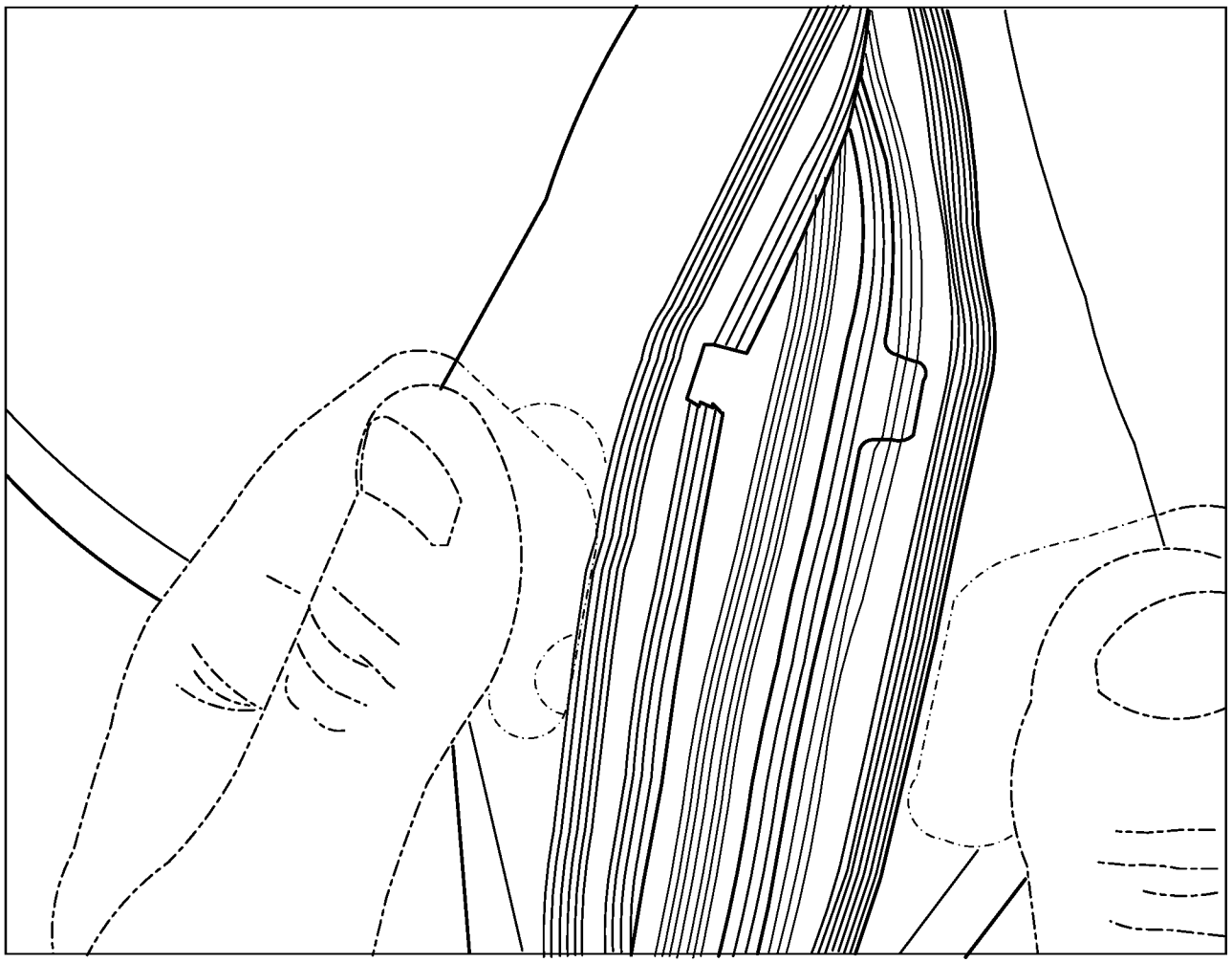
Figure 6C:
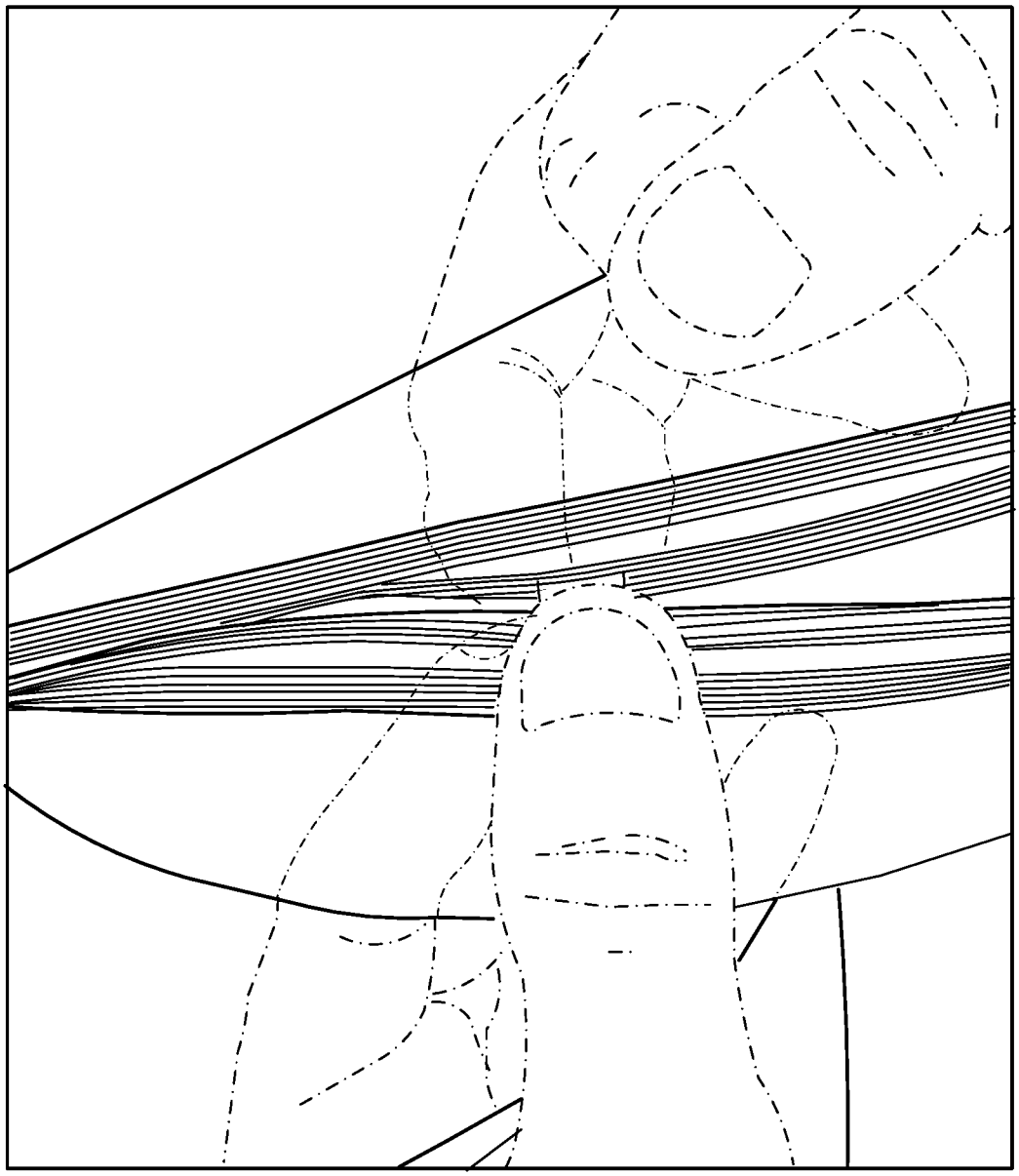
Figure 6D:
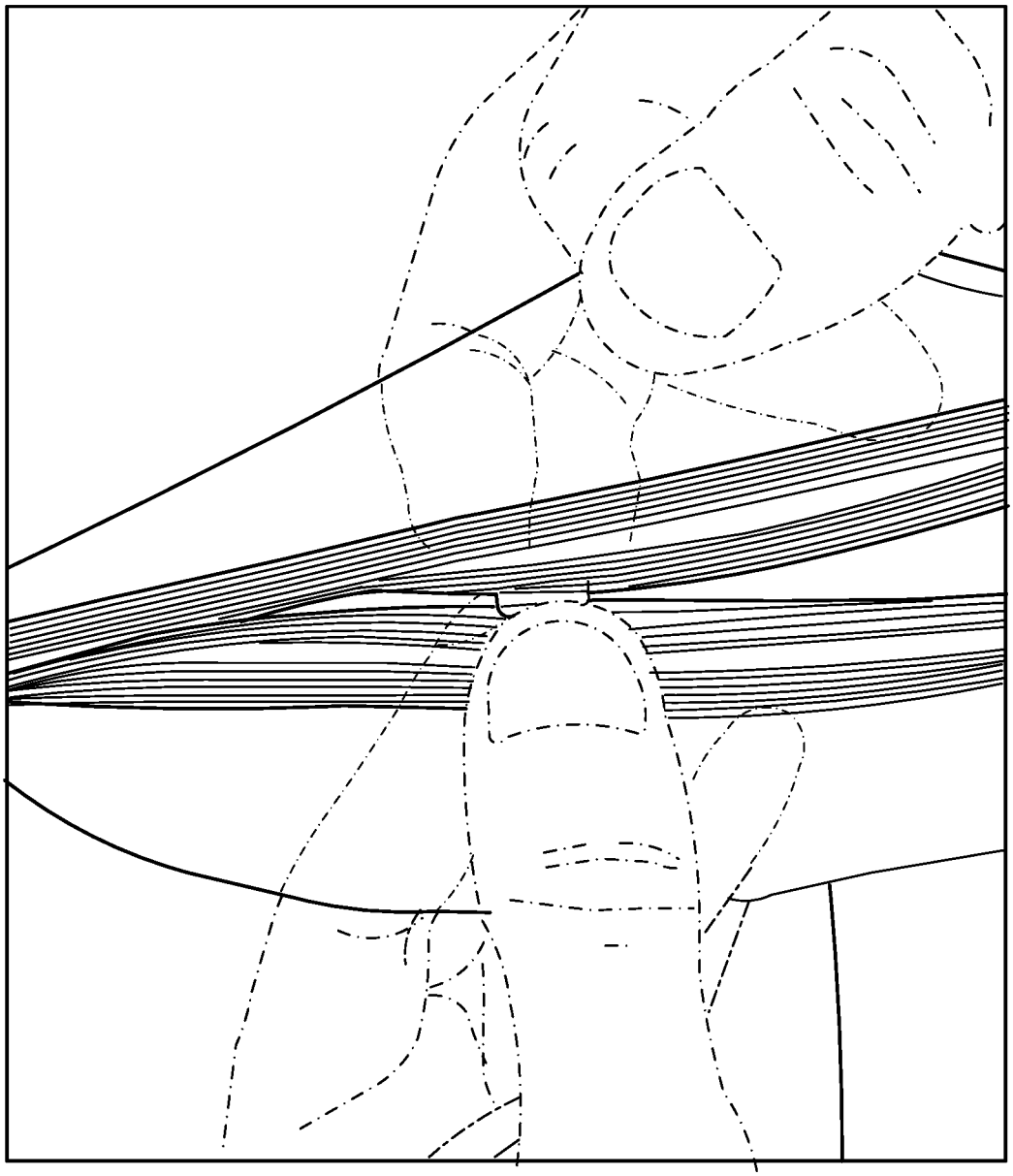
Figure 6E:
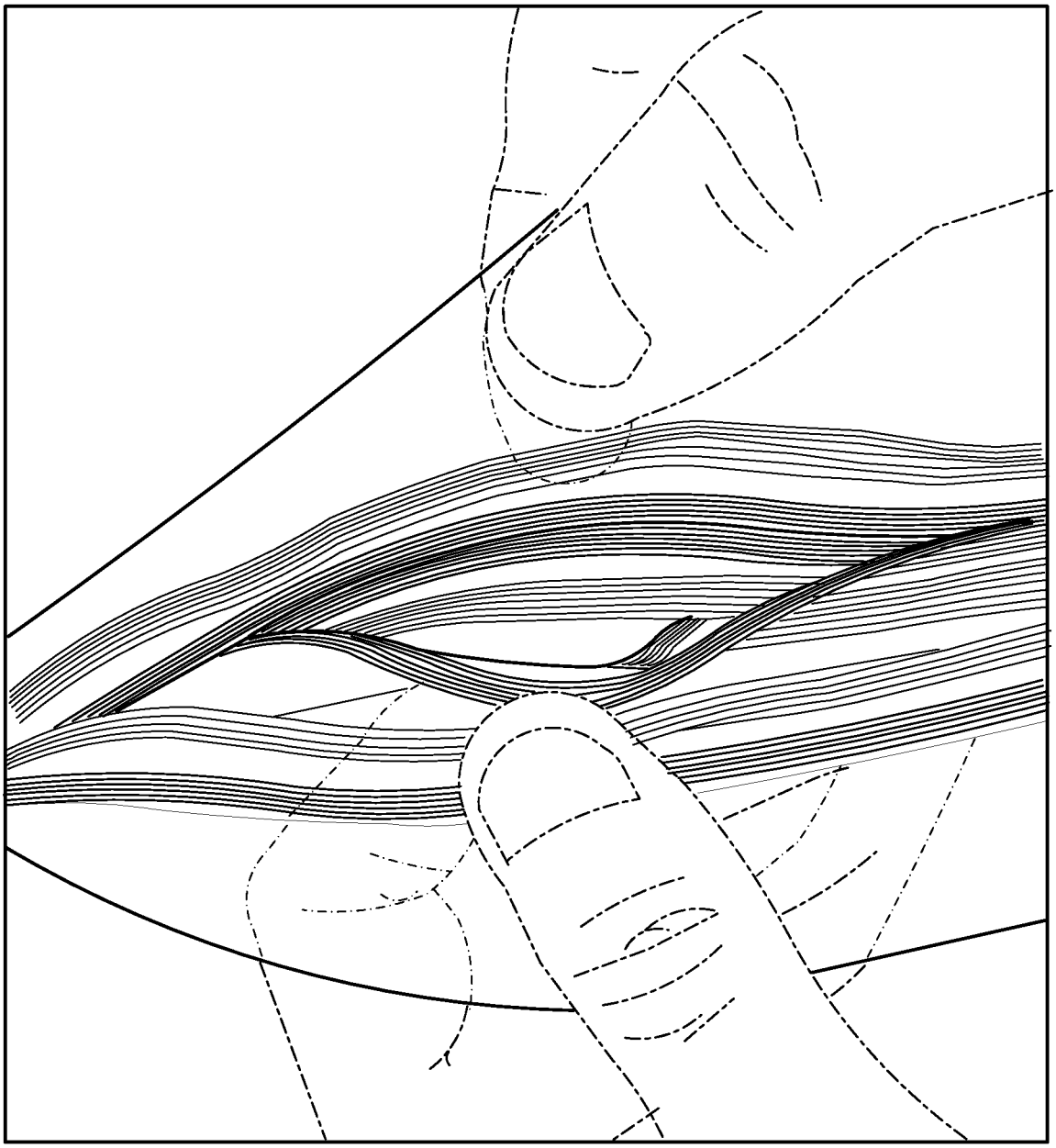
Figure 6F:
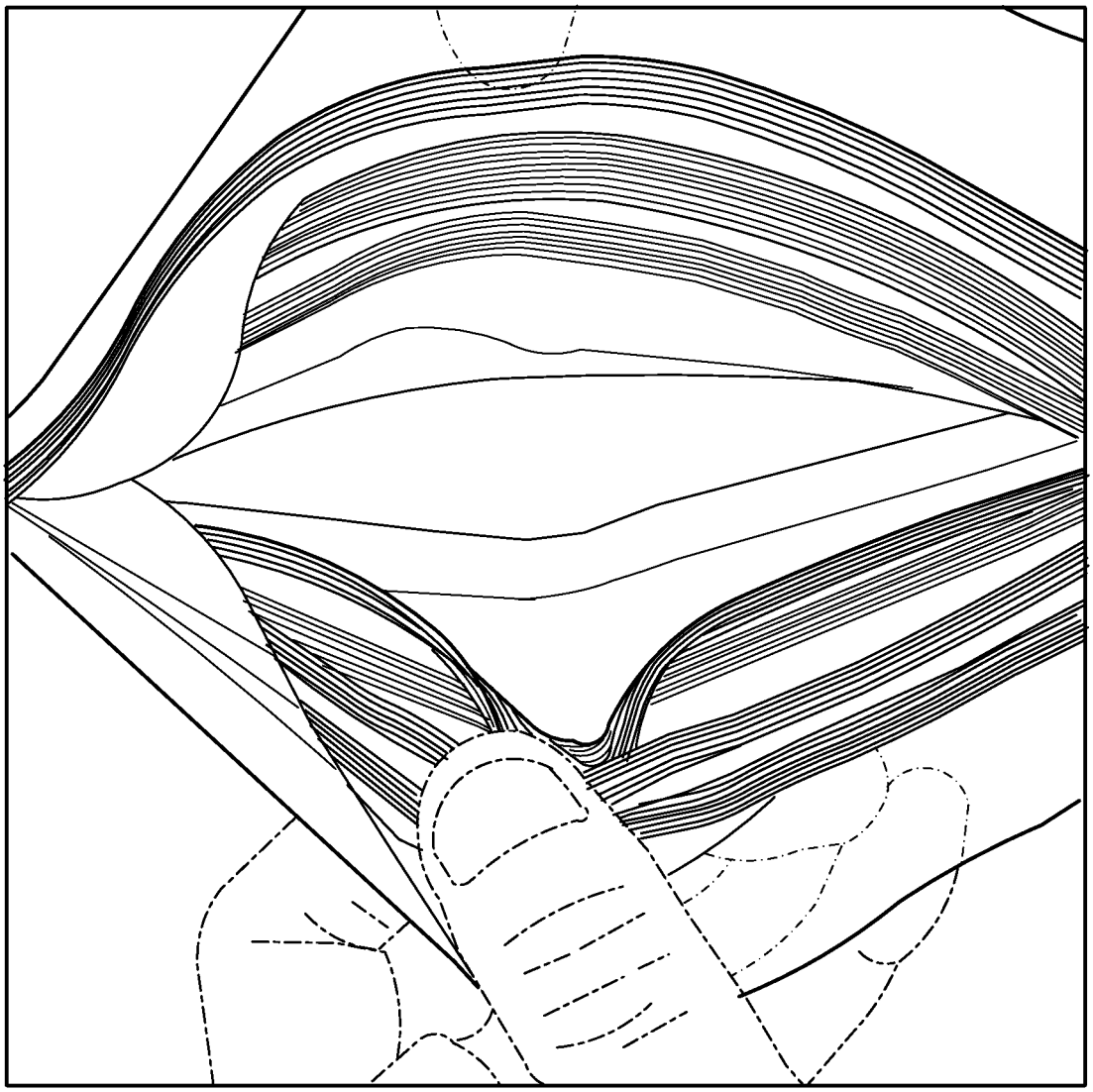

FIGS. 6A-6F illustrate an opening sequence for the closure, reclosure or zipper 10 of the present disclosure. In FIG. 6A, the first upper sealing flange 21 and the second upper sealing flange 34 are separated to expose a tab 18. In FIG. 6B, the first upper interlocking tracks 29 on upper first profile 12" has been separated from second upper interlocking tracks 46, while tab 18 (on lower first profile 12') remains interlocked with the second upper interlocking tracks 46 on second profile 14. In FIG. 6C, the tab 18 has been peeled from second upper interlocking tracks 46. In FIG. 6D, tab 18 has been manually engaged and pulled to separate first and second lower interlocking tracks 28, 44 from each other. In FIG. 6D, the first and second lower interlocking tracks 28, 44 are separated from each other. In FIGS. 6E-6F, the closure, reclosure or zipper 10 (and therefore the package or bag 100) is open. Reclosing the closure, reclosure or zipper 10 may be done in reverse order to the described opening sequence. In particular, the user should mate the first and second lower interlocking tracks 28, 44 to each other, the tab tracks 29' to the second upper interlocking tracks 46, and first and second upper interlocking tracks 29, 46 to each other.

In summary, this configuration, including the sequence of multiple opening steps, contributes to the child-resistant characteristics of reclosure 10, and therefore, package 100. In the interlocked configuration, there is no way for a user to grip first profile 12 effectively, in order to separate the first and second lower interlocking tracks 28, 44, other than by grasping or gripping tab 18. However, the user is unable to manually grip or grasp tab 18 while first and second upper interlocking tracks 29, 46 are interlocked with each other. In order to get tab 18 into a grippable position, the user must first peel the tab 18 away from second profile 14 and then grip the tab 18 and pull the first profile 12 away from the second profile 14.

Thus, the several aforementioned objects and advantages are most effectively attained. Although preferred embodiments of the invention have been disclosed and described in detail herein, it should be understood that this invention is in no sense limited thereby.

What is claimed is:

1. A reclosure (10) for a reclosable package (100), including:

a first profile (12) and a second profile (14);

the first profile (12) including a first web portion (16) with a first lower interlocking element (28) and a first upper interlocking element (29), wherein first profile (12) is severed through the first upper interlocking element (29) to form a lower first profile (12') and an upper first profile (12") thereby forming at least one tab (18) extending from an upper edge of the lower first profile (12') and including a portion of the first upper interlocking element (29'); and the second profile (14) including a second web portion (30) with a second lower interlocking element (44) and a second upper interlocking element (46).

2. The reclosure (10) of claim 1 wherein the lower first profile (12') includes a first lower sealing flange (20) and the upper first profile (12") includes a first upper sealing flange (21).

3. The reclosure (10) of claim 1 wherein the second profile (14) includes a second lower sealing flange (32) and a second upper sealing flange (34).

4. The reclosure (10) of claim 1 wherein the lower first profile (12') and the upper first profile (12") are separated by severing the first profile (12).

5. The reclosure (10) of claim 1 wherein the at least one tab (18) includes a plurality of tabs (18).

6. The reclosure (10) of claim 5 wherein the plurality of tabs (18) are spaced periodically along the upper edge of the lower first profile (12').

7. The reclosure (10) of claim 6 wherein, in an interlocked configuration, the plurality of tabs (18) are interlocked with the second upper interlocking elements (46).

8. The reclosure (10) of claim 7 wherein the plurality of tabs (18) are pealed from the second upper interlocking elements (46) to open the reclosure (10).

9. The reclosure (10) of claim 1 wherein, in an interlocked configuration, the first and second upper interlocking elements (29, 46) are interlocked with each other and the first and second lower interlocking elements (28, 44) are interlocked with each other.

10. The reclosure (10) of claim 1 wherein the first lower and upper interlocking elements (28, 29) and the second lower and upper interlocking elements (44, 46) extend longitudinally along the reclosure (10) in parallel.

11. The reclosure (10) of claim 1 wherein interior surfaces of a first lower sealing flange (20), a first upper sealing flange (21), a second lower sealing flange (32) and a second upper sealing flange (34) include anti-sealing protrusions (26, 27, 40, 42).

12. The reclosure (10) of claim 11 wherein the anti-sealing protrusions (26, 27, 40, 42) extend longitudinally along the reclosure (10).

13. The reclosure (10) of claim 1 wherein the reclosure (10) is comprised of polymeric material.

14. The reclosure (10) of claim 1 wherein the upper first profile (12") includes a first upper sealing flange (21) and a portion of the first upper interlocking element (29).

15. The reclosure (10) of claim 14 wherein the first upper sealing flange (21) includes anti-sealing protrusions (26) on an interior surface thereof.

* * * * *